US009278560B2

(12) United States Patent
Tsuyama

(10) Patent No.: US 9,278,560 B2
(45) Date of Patent: Mar. 8, 2016

(54) RECORDING APPARATUS

(71) Applicant: SEIKO EPSON CORPORATION, Tokyo (JP)

(72) Inventor: Kazuhiko Tsuyama, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/222,286

(22) Filed: Mar. 21, 2014

(65) Prior Publication Data

US 2014/0292897 A1 Oct. 2, 2014

(30) Foreign Application Priority Data

Mar. 29, 2013 (JP) ..... 2013-071635

(51) Int. Cl.

| | |
|---|---|
| ***B41J 29/13*** | (2006.01) |
| ***B41J 23/00*** | (2006.01) |
| ***B41J 29/02*** | (2006.01) |
| ***B41J 29/393*** | (2006.01) |

(52) U.S. Cl.

CPC ..... *B41J 23/00* (2013.01); *B41J 29/023* (2013.01); *B41J 29/393* (2013.01)

(58) Field of Classification Search

CPC ..... B41J 23/00; B41J 29/023; B41J 29/393
USPC ..... 347/20
See application file for complete search history.

(56) References Cited

U.S. PATENT DOCUMENTS

| | | | | | |
|---|---|---|---|---|---|
| 5,049,999 | A * | 9/1991 | Stemmle | 358/296 | |
| 5,481,290 | A * | 1/1996 | Watanabe et al. | 347/104 | |
| 5,785,441 | A * | 7/1998 | Kobayashi et al. | 400/633 | |
| 6,095,700 | A * | 8/2000 | Negishi | B41J 2/355 | 347/192 |
| 6,382,761 | B1 * | 5/2002 | Asano | B41J 29/393 | 347/19 |
| 2002/0021320 | A1 * | 2/2002 | Miyazawa | B41J 29/393 | 347/19 |
| 2002/0158962 | A1 * | 10/2002 | Ishikawa | 347/215 | |
| 2004/0067089 | A1 | 4/2004 | Tanaami et al. | | |
| 2006/0066705 | A1 * | 3/2006 | James et al. | 347/104 | |

FOREIGN PATENT DOCUMENTS

| | | |
|---|---|---|
| JP | 3600173 | 9/2004 |
| JP | 4387651 | 10/2009 |

* cited by examiner

*Primary Examiner* — Stephen Meier
*Assistant Examiner* — Alexander D Shenderov
(74) *Attorney, Agent, or Firm* — Workman Nydegger

(57) ABSTRACT

A recording apparatus includes a recording unit that performs recording on a medium which is transported from the side of a second surface which is opposite to a first surface which forms a periphery of an apparatus body to the side of the first surface, a delivery section that delivers the medium on which recording has been performed by the recording head from the side of the first surface, a notch section formed at a corner formed by an upper surface and the second surface of the apparatus body, and a battery which is attached on the notch section and forms part of the upper surface and part of the second surface of the apparatus body in a state that the battery is attached.

14 Claims, 9 Drawing Sheets

RECORDING APPARATUS

BACKGROUND

1. Technical Field

The present invention relates to recording apparatuses such as facsimile machines and printers.

2. Related Art

In portable electronic devices such as digital cameras and note-type personal computers, a battery is removably attached to a main body of the device. Recording apparatuses such as facsimile machines and printers also use a battery and are formed small-sized, light-weight and portable. Examples of such recording apparatuses are disclosed in Japanese Patent No. 3600173 and Japanese Patent No. 4387651.

In printers disclosed in Japanese Patent No. 3600173 and Japanese Patent No. 4387651, a battery mounting surface extends over the entire back face of the apparatus, that is, the battery mounting surface is designed to be accessed from the back side of the apparatus for attachment and removal of the battery. Accordingly, a user needs to turn the printer so that the back face of the printer is oriented forward and the user can visually observe the battery mounting surface for attachment and removal of the battery. As a result, such printers do not always have good operability since the orientation of the printer during printing and the orientation of the printer during attachment and removal of the battery are different.

In addition, in the printers disclosed in Japanese Patent No. 3600173 and Japanese Patent No. 4387651, the overall size of the apparatus including the battery is increased on the back side of the apparatus since the battery is attached on the back side. Accordingly, there has been a problem in that the apparatuses designed to be portable do not have good portability.

SUMMARY

An advantage of some aspects of the invention is that a recording apparatus that allows for easy attachment and removal of a battery and has a small size for improved portability is provided.

According to an aspect of the invention, a recording apparatus includes an apparatus body which includes a recording unit that performs recording on a medium, a delivery unit that delivers the medium on which recording has been performed by the recording unit, and a battery which is attached on an upper surface of the apparatus body and forms part of the upper surface of the apparatus body in a state that the battery is attached.

With this configuration, the battery is attached on the upper surface of the apparatus body and forms part of the upper surface of the apparatus body in a state that the battery is attached. Accordingly, since the battery is fit in the apparatus body, the overall size of the apparatus becomes smaller and the portability of the apparatus is improved.

According to above aspect of the invention, the recording apparatus may include a medium supporting section that supports at least part of the medium before feeding of the medium, the medium supporting section being formed to be inclined downward in a feeding direction of the medium, wherein the medium supporting section is disposed between the recording unit and the battery.

According to above aspect of the invention, the recording apparatus may include a feeding unit that supports at least part of the medium before feeding of the medium, the feeding unit being formed to be inclined downward in a feeding direction of the medium, wherein the battery is disposed under the feeding unit.

According to above aspect of the invention, the apparatus body may include a circuit substrate on which a plurality of electronic components are mounted. The circuit substrate may be disposed under the battery in a position along a lower surface of the battery, the circuit substrate may be sized to extend from a position under the battery toward the recording head, and the electronic component which extends upward from the circuit substrate by a predetermined amount or more among the plurality of electronic components may be positioned such that the occupied region of the electronic component overlaps the occupied region of the battery in a height direction of the apparatus at a position other than under the battery in a plane direction of the circuit substrate.

With this configuration, the electronic component which extends upward from the circuit substrate by a predetermined amount or more among a plurality of electronic components is positioned such that the occupied region of the electronic component overlaps the occupied region of the battery in the height direction of the apparatus at a position other than under the battery in a plane direction of the circuit substrate. Accordingly, the electronic component which extends upward from the circuit substrate by a predetermined amount or more can be efficiently positioned, thereby preventing the height dimension of the apparatus from being increased.

According to above aspect of the invention, the electronic component which extends from the circuit substrate by a predetermined amount or more may be positioned in an area formed under the feeding unit. With this configuration, the medium supporting section that supports at least part of the medium before feeding of the medium is formed to be inclined downward in the feeding direction of the medium, a space is created under the medium supporting section. The electronic component which extends upward from the circuit substrate by a predetermined amount or more is positioned in the space. Accordingly, the space is effectively used, thereby contributing to reduction of the overall size of the apparatus.

According to above aspect of the invention, the recording unit may include a recording head that ejects ink and an ink storing unit that collects ink ejected from the recording head, wherein the ink storing unit is disposed under the battery. This configuration can also contribute to reduction of the overall size of the apparatus. According to above aspect of the invention, the apparatus body may include at least two drive motors, and each of the two drive motors is disposed on a respective side of a medium transport path in a transportation direction of the medium. With this configuration, each of the two drive motors is disposed on each side of the battery in a first direction. Accordingly, the weight of the entire apparatus is balanced in the first direction, thereby improving the portability of the recording apparatus.

According to above aspect of the invention, the battery may be disposed at a corner formed by the upper surface and one surface which forms a periphery of the apparatus body, and a frame that forms a surface which opposes the battery in the notch section may be a separate member from a frame that forms at least the upper surface and a second surface of the apparatus body.

With this configuration, the frame that forms a surface which opposes the battery in the notch section is a separate member from a frame that forms at least the upper surface and the second surface of the apparatus body. Accordingly, the circuit substrate disposed under the battery and an area around the circuit substrate can be easily accessed, thereby improving the operation efficiency during a wiring operation for the circuit substrate.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described below with reference to the drawings. The same reference numbers in the embodiments refer to the same elements. The description of the elements is provided only in the embodiment in which the element first appears and is omitted in the subsequent embodiments.

Figure 1:
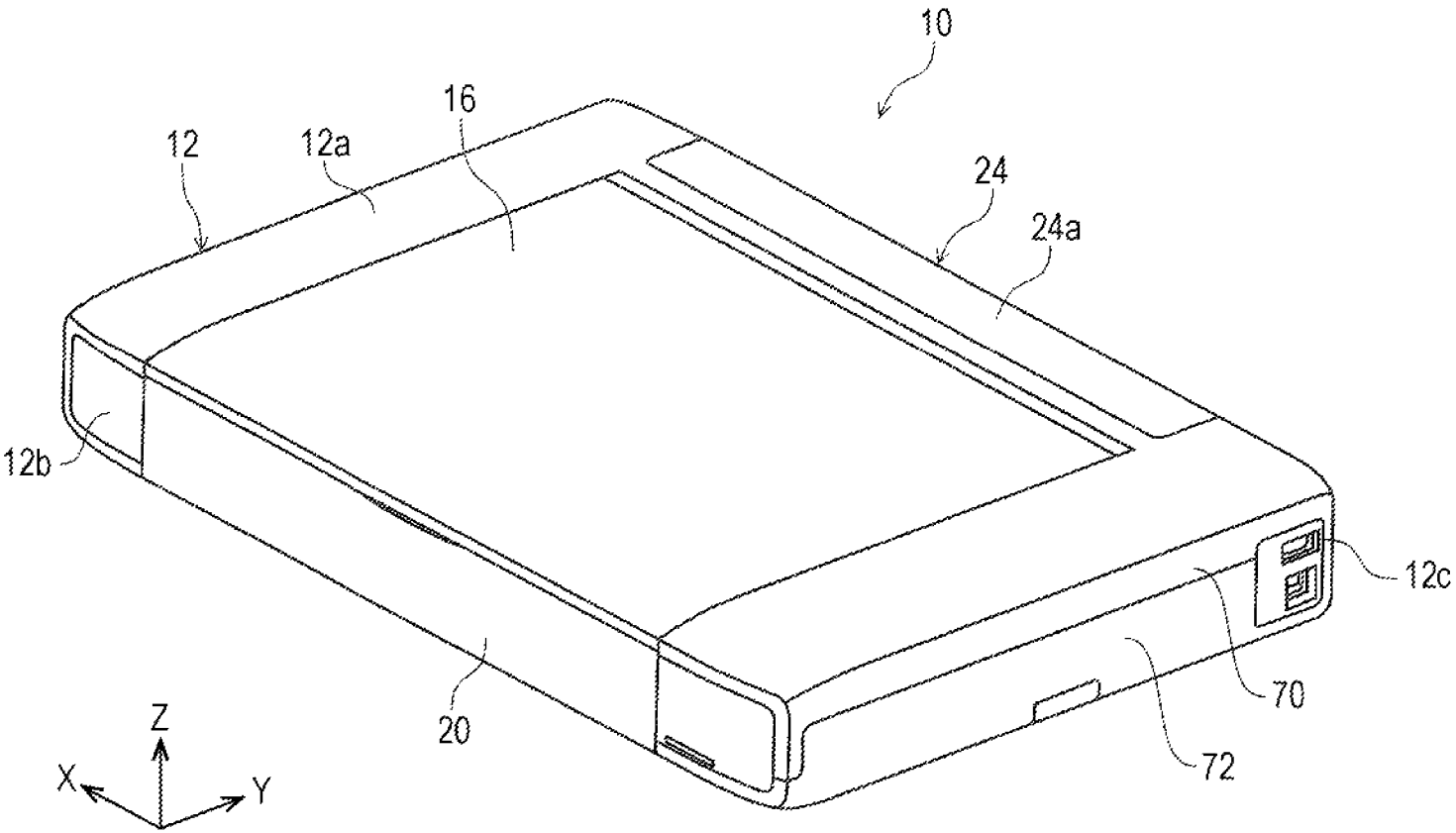
FIG. 1 is a perspective view of a printer according to the invention.
Figure 2:
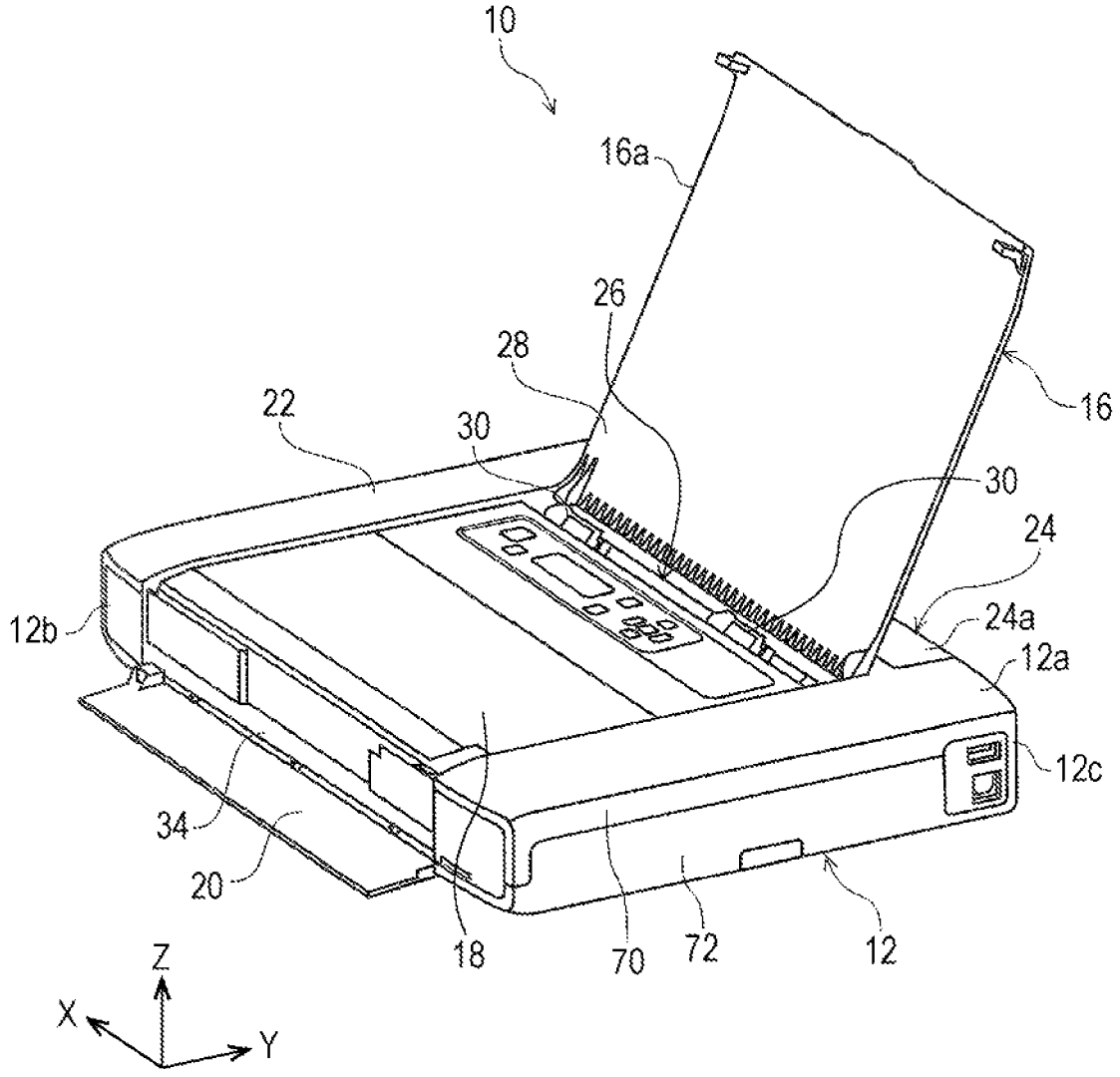
FIG. 2 is a perspective view of the printer according to the invention which shows a cover is open.
Figure 3:
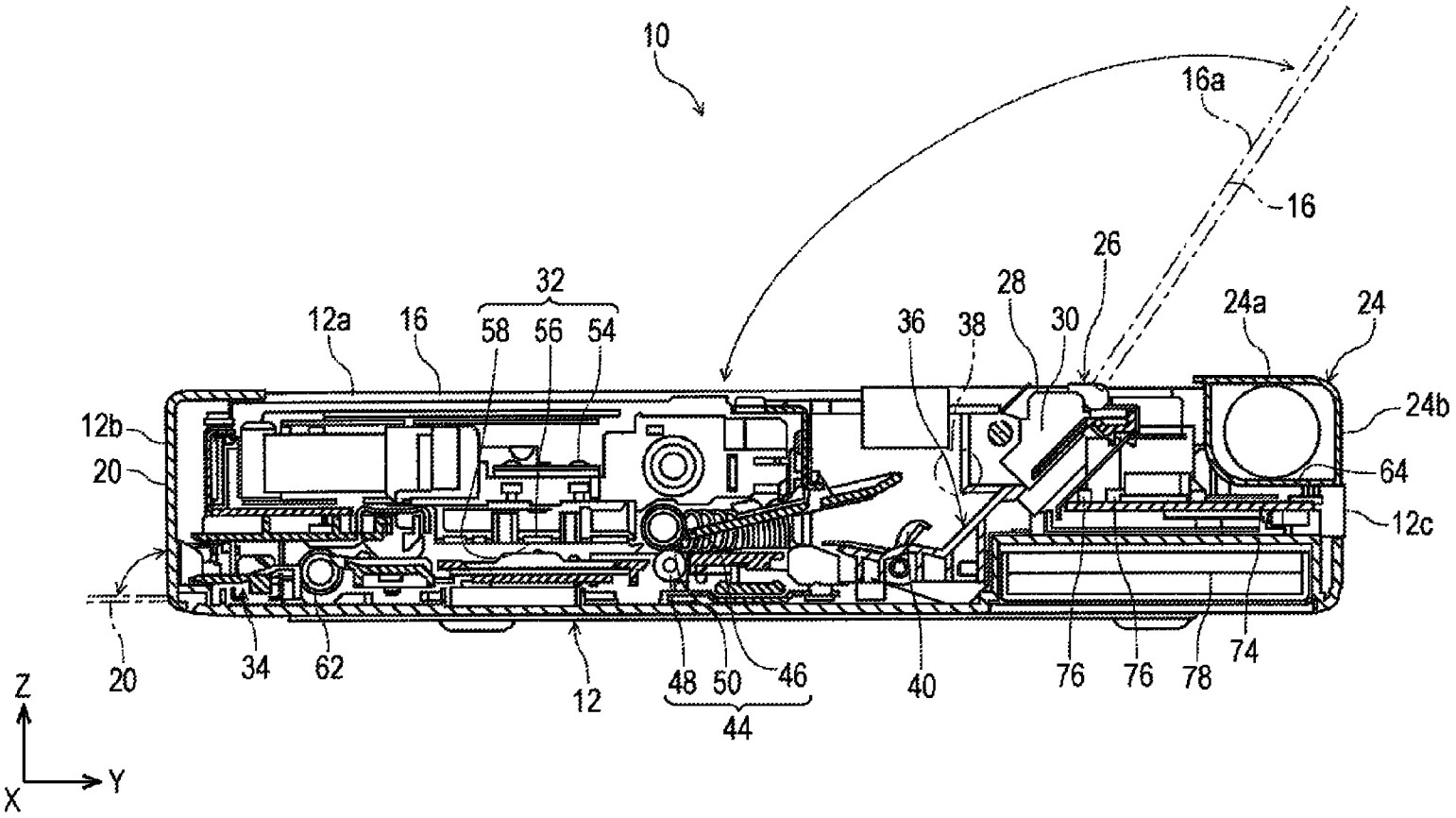
FIG. 3 is a side sectional view of the printer according to the invention.
Figure 4:
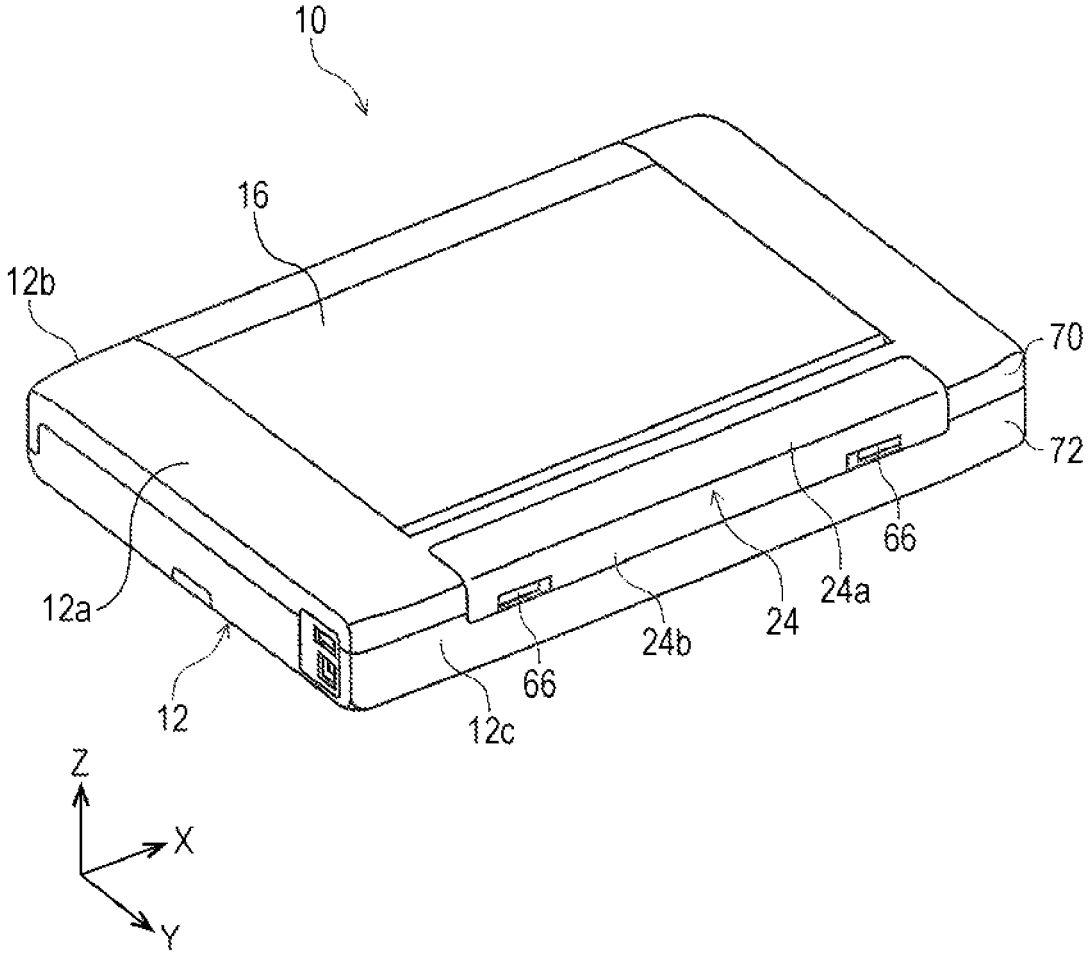
FIG. 4 is a perspective view of the back side of the printer according to the invention (in the state that a battery is mounted).
Figure 5:
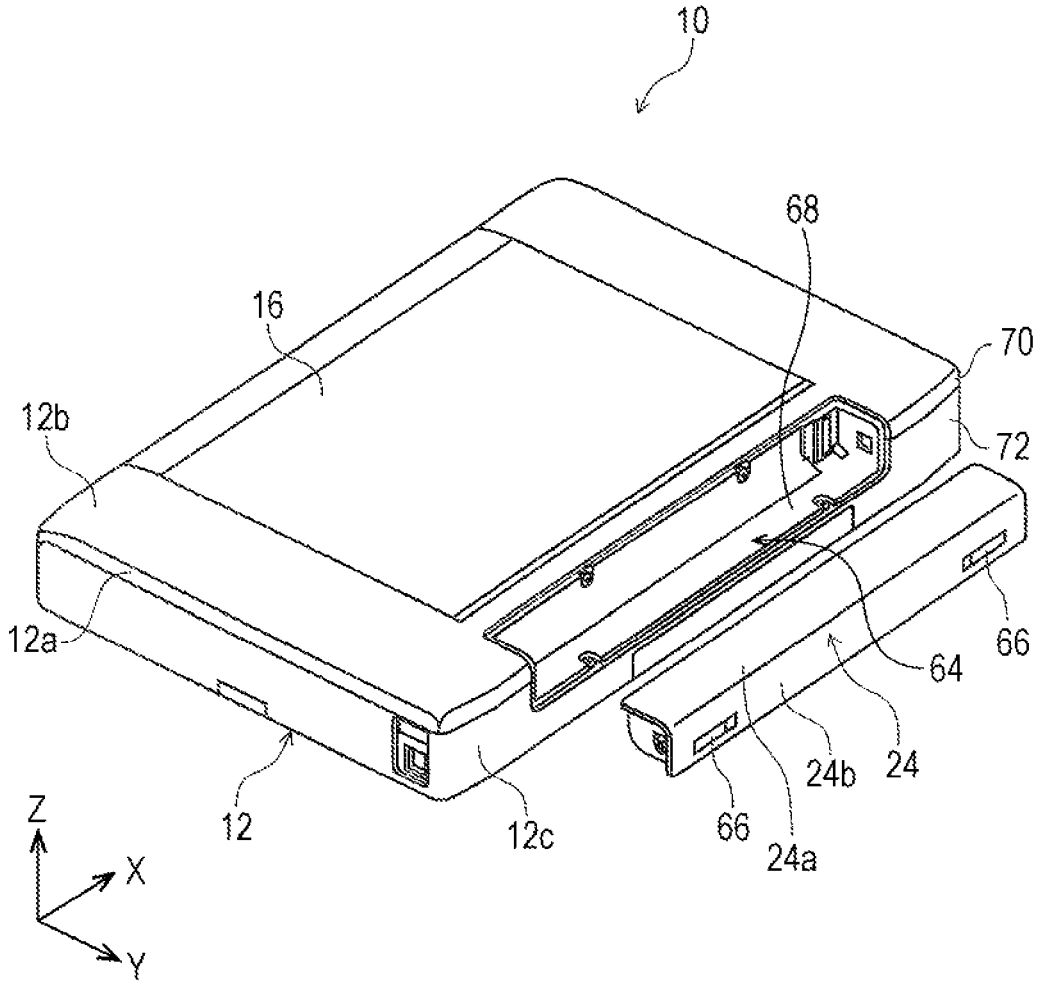
FIG. 5 is a perspective view of the back side of the printer according to the invention (in the state that a battery is removed).

FIG. 1 is a perspective view of a printer according to the invention. FIG. 2 is a perspective view of the printer according to the invention which shows a cover is open. FIG. 3 is a side sectional view of the printer according to the invention. FIG. 4 is a perspective view of the back side of the printer according to the invention (in the state a battery is mounted). FIG. 5 is a perspective view of the back side of the printer according to the invention (in the state a battery is removed).

Figure 6:
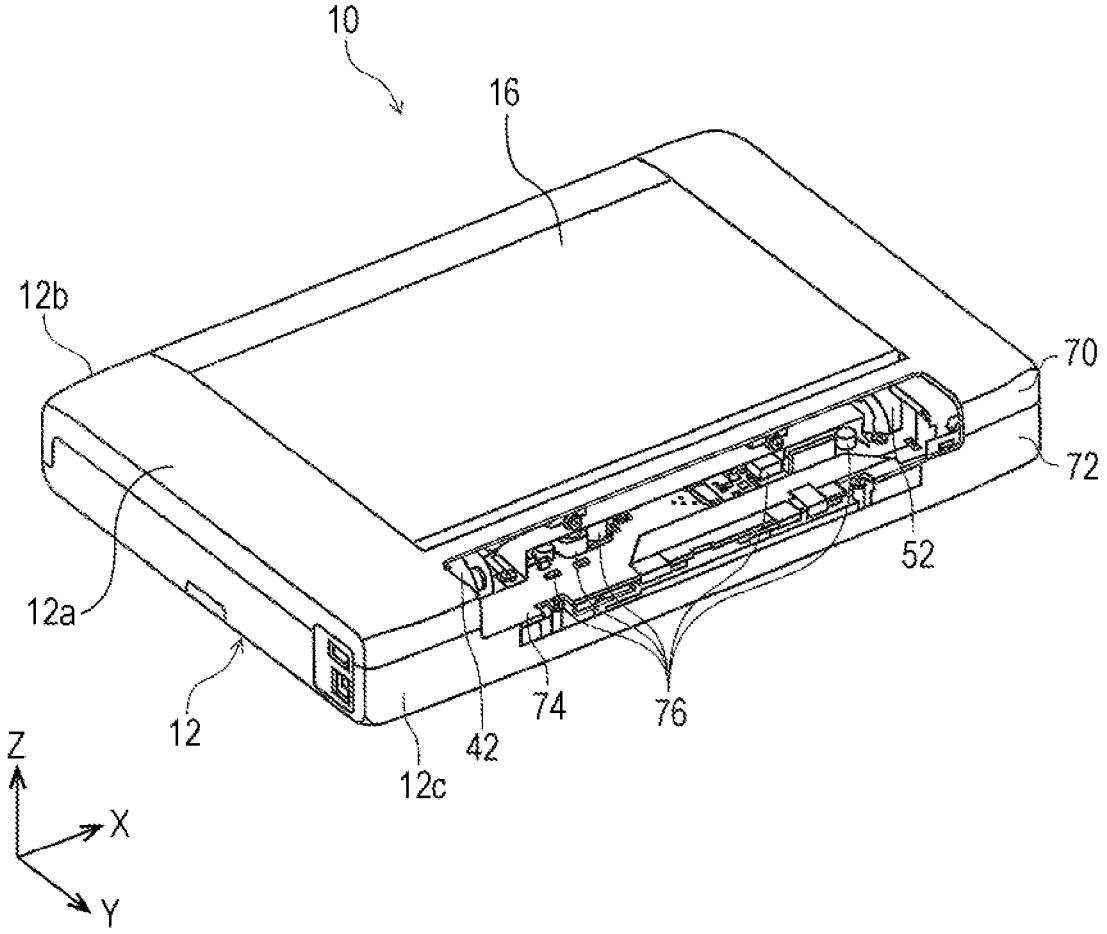
FIG. 6 is a perspective view which shows a frame that forms a notch section is removed from an apparatus body of the printer according to the invention.
Figure 7:
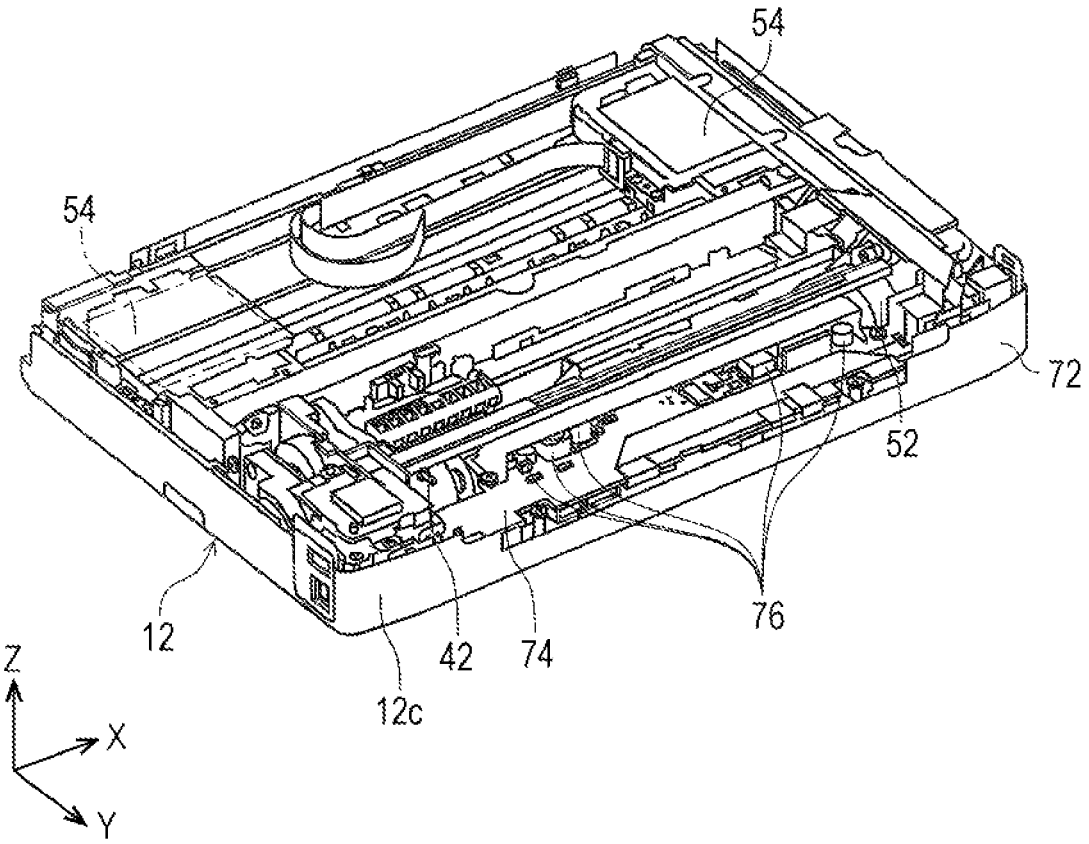
FIG. 7 is a perspective view which shows an inner configuration of the apparatus body of the printer according to the invention.
Figure 8:
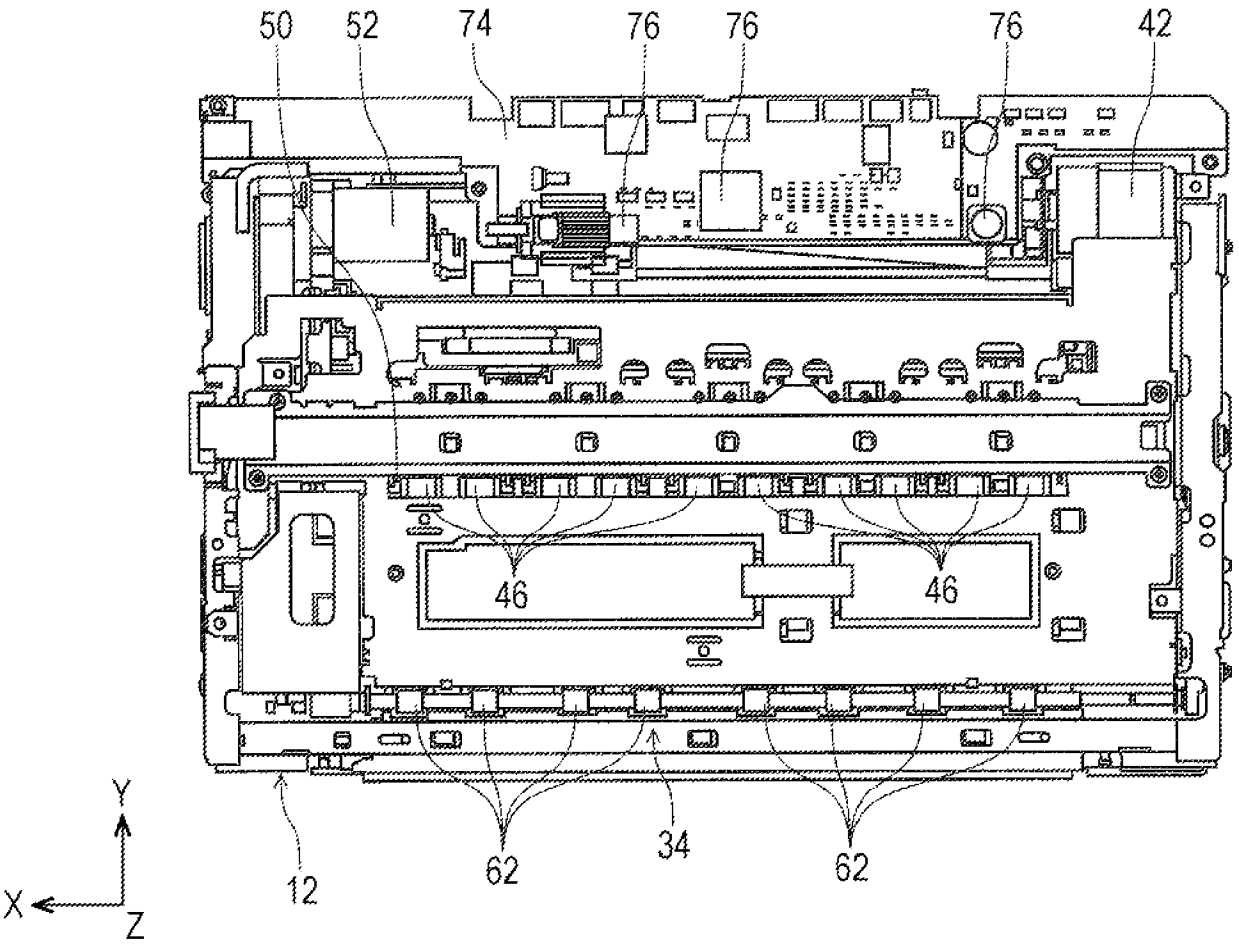
FIG. 8 is a plan view which shows the inner configuration of the apparatus body of the printer according to the invention.
Figure 9:
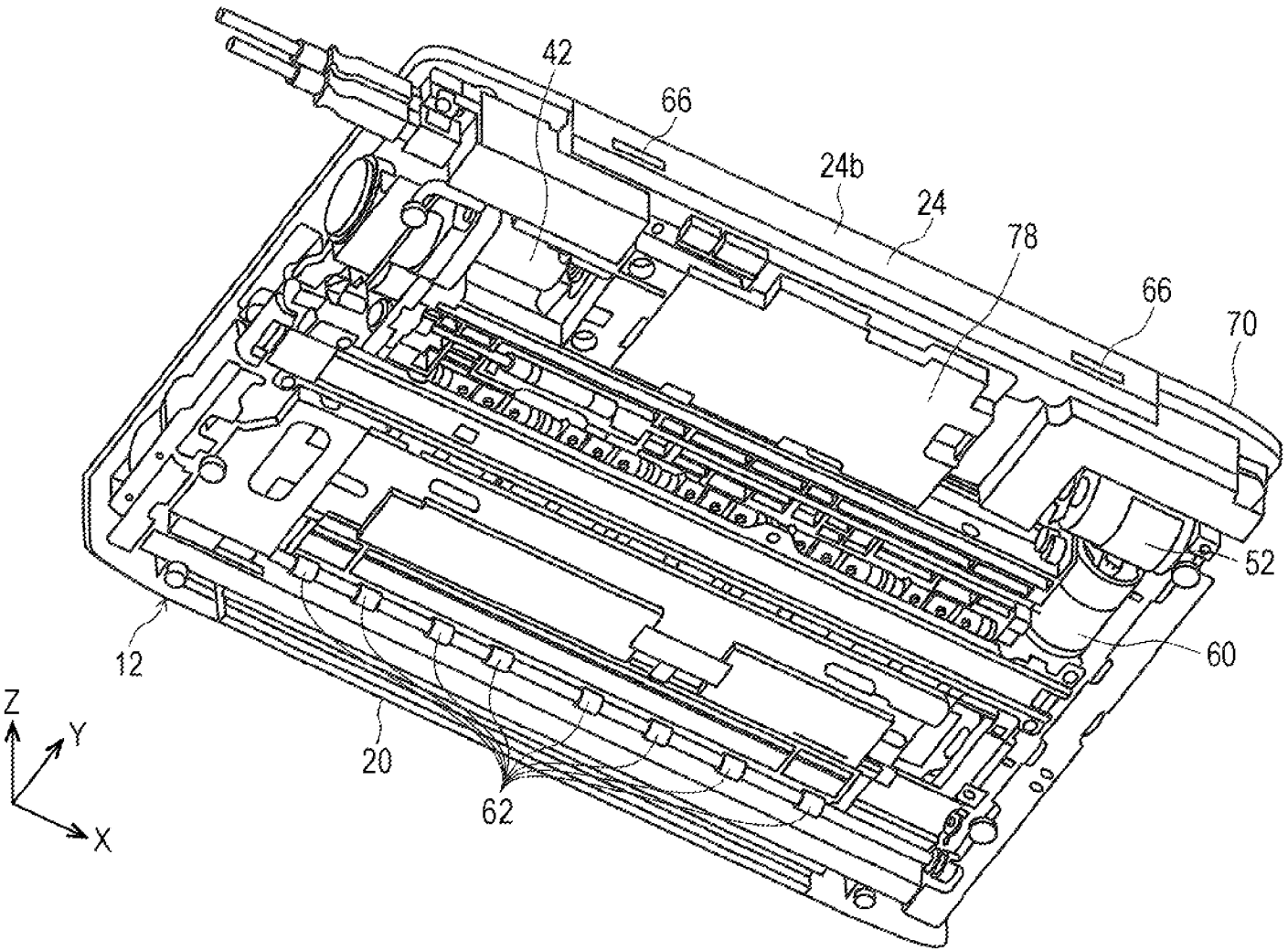
FIG. 9 is a perspective view which shows the inner configuration of the apparatus body of the printer according to the invention from the bottom side.

FIG. 6 is a perspective view which shows a frame that forms a notch section is removed from an apparatus body of the printer according to the invention. FIG. 7 is a perspective view which shows an inner configuration of the apparatus body of the printer according to the invention. FIG. 8 is a plan view which shows the inner configuration of the apparatus body of the printer according to the invention. FIG. 9 is a perspective view which shows the inner configuration of the apparatus body of the printer according to the invention from the bottom side.

In the X-Y-Z coordinates in the drawings, the X axis indicates a scanning direction of a recording head, the Y axis indicates a depth direction of the recording apparatus, and the Z axis indicates a direction in which a distance (gap) between the recording head and a medium varies, that is, a height direction of the recording apparatus. Throughout the drawings, the negative Y direction indicates a front side of the apparatus and the positive Y direction indicates a back side of the apparatus.

In FIG. 1, a printer 10 according to the invention has a face on the front side of the apparatus (on the side of the negative Y direction) which is referred to as a "first surface," a face on the back side of the apparatus (on the side of the positive Y direction) which is referred to as a "second surface," a face on the right side of the apparatus (on the side of the negative X direction) which is referred to as a "third surface," and a face on the left side of the apparatus (on the side of the positive X direction) which is referred to as a "fourth surface." Further, the X axis direction is referred to as a "first direction" and the Y axis direction is referred to as a "second direction."

Brief Description of Recording Apparatus

An overall configuration of the printer 10 will be described with reference to FIGS. 1 and 2. The printer 10 includes an apparatus body 12, a medium supply unit cover 16, a recording unit protection cover 18 (see FIG. 2), a delivery section cover 20, an operation section 22 (see FIG. 2) and a battery 24. The battery 24 will be described later in detail.

The medium supply unit cover 16 is disposed on an upper surface 12*a* of the apparatus body 12. The medium supply unit cover 16 is pivotally attached on the upper surface 12*a* of the apparatus body 12. The medium supply unit cover 16 can assume a state in which it is open from the apparatus body 12 (see FIG. 2) and a state in which it is closed on the apparatus body 12 (see FIG. 1). When the medium supply unit cover 16 is closed on the apparatus body 12, the medium supply unit cover 16 and the upper surface 12*a* of the apparatus body 12 form the top of the printer 10.

When the medium supply unit cover 16 is open from the apparatus body 12 (see FIG. 2), the medium supply unit cover 16 is inclined toward the back side of the printer 10 (in the positive Y direction). In this state, the backside surface of the medium supply unit cover 16 serves as a medium placing surface 16*a*.

Further, when the medium supply unit cover 16 is open from the apparatus body 12, a medium opening section 28 of a medium supply unit 26 of the apparatus body 12, which is described later, is open to the top of the printer 10. Accordingly, the medium supply unit 26 can feed the medium placed on the medium placing surface 16*a* to a feeding passage, which is described later. Further, a pair of medium guides 30 which is configured to come into contact with and separate from each other in the width direction (the X axis direction) is provided in the medium opening section 28. The pair of medium guides 30 restrains both ends of the medium in the width direction and defines the position of the medium in the apparatus width direction.

Further, when the medium supply unit cover 16 is open from the apparatus body 12, the recording unit protection cover 18 and an operation section 22 are exposed to the top of the printer 10. The recording unit protection cover 18 can assume a state in which it is open from the apparatus body 12 (which is not shown in the figure) and a state in which it is closed on the apparatus body 12 (see FIG. 2). When recording unit protection cover 18 is open from the apparatus body 12, a user can access a recording unit 32 of the apparatus body 12, which is described later.

The operation section 22 includes a power supply button, a print setting button and the like for operating the printer 10. When the medium supply unit cover 16 is open from the apparatus body 12, a user can access the operation section 22 and operate the printer 10.

Further, the delivery section cover 20 is disposed on a front face 12*b* of the apparatus body 12. The delivery section cover 20 is pivotally attached on the front face 12*b* of the apparatus body 12. The delivery section cover 20 can assume a state in which it is open from the apparatus body (see FIG. 2) and a state in which it is closed on the apparatus body 12 (see FIG. 1). When the delivery section cover 20 is open from the apparatus body 12, the delivery section cover 20 allows the medium to be delivered from a delivery section 34 which serves as a "delivery unit" of the apparatus body 12 after recording is performed on the medium.

Medium Feeding Passage

Next, components in a medium feeding passage of the printer 10 will be described in detail with reference to FIG. 3. In FIG. 3, the right side of the drawing (the back side of the apparatus) is upstream of the feeding passage, and the left side of the drawing (the front side of the apparatus) is downstream of the feeding passage.

The medium supply unit 26 is disposed in an upstream region of the feeding passage and feeds the medium downstream in the feeding passage from the medium placing surface 16*a* of the medium supply unit cover 16 (indicated by the dashed-dotted line in FIG. 3) which is open from the apparatus body 12. The medium supply unit 26 includes the medium opening section 28, the pair of medium guides 30 that is disposed in the medium opening section 28, a medium supporting section 36 that supports at least part of the medium supplied through the medium opening section 28, a pick-up roller 38 that is disposed at a position which opposes the medium supporting section 36 and a return lever 40.

The medium supporting section 36 is formed to be inclined downward in the negative Y direction in FIG. 3. The pick-up roller 38 is swingably movable so as to come into contact with and separate from the medium placed on the medium supporting section 36. Further, the pick-up roller 38 rotates by a driving force of a first drive motor 42 as a "drive motor" (see FIG. 6) via a transmission mechanism, which is not shown in the figure. When the pick-up roller 38 moves to come into contact with the medium supporting section 36, the pick-up roller 38 abuts the uppermost sheet of the media placed on the medium supporting section 36 and feeds the uppermost medium downstream in the feeding passage. The subsequent sheets are returned to the medium supporting section 36 by the return lever 40 so as to prevent the subsequent sheets from being inadvertently fed downstream in the feeding passage.

A transportation section 44 is disposed downstream with respect to the medium supply unit 26. The transportation section 44 includes a transportation drive roller 46 and a transportation driven roller 48. The transportation drive roller 46 is integrally mounted on a transportation roller shaft 50 and rotates with the transportation roller shaft 50 by a second drive motor 52 as a "drive motor" (see FIG. 6). The transportation section 44 transports the medium which has been fed from the medium supply unit 26 downstream in the feeding passage by nipping the medium between the transportation drive roller 46 and the transportation driven roller 48. The recording unit 32 is disposed downstream with respect to the transportation section 44.

The recording unit 32 includes a carriage 54, a recording head 56 that forms a "recording unit" disposed on the underside of the carriage, and a platen 58, that is, a lower guiding member which opposes the recording head and supports the medium as a supporting member. The recording head 56 opposes the medium supported on the platen 58. The carriage 54 is configured to reciprocate in a main scan direction (the direction across the drawing of FIG. 3 between the front side and the back side of the drawing, that is, the X axis direction) by a third drive motor 60 (see FIG. 9) that is controlled by a control unit (not shown in the figure) which is disposed in the apparatus body 12. Further, the platen 58 supports the medium from the underside to define a distance between a recording surface of the medium and a head surface of the recording head 56.

The delivery section 34 is disposed downstream with respect to the recording unit 32 in the transportation direction. The delivery section 34 includes a delivery roller 62. After recording is performed on the medium in the recording unit 32, the medium is delivered by the delivery roller 62 downstream with respect to the delivery section 34, that is, toward the front side of the apparatus.

Battery

Next, the battery 24 according to the embodiment will be described in detail with reference to FIGS. 1, 3 through 9. Referring to FIG. 5, in the printer 10, a notch section 64 is formed at a corner formed by the upper surface (positive Z direction in FIG. 5) and the back face (positive Y direction in FIG. 5) of the apparatus body 12. As shown in FIGS. 4 and 5, the battery 24 is removably attached to the notch section 64.

In the state that the battery 24 is attached to the notch section 64, an upper surface 24*a* of the battery 24 is flush with the upper surface 12*a* of the apparatus body 12. Accordingly, the upper surface 24*a* of the battery 24 forms part of the upper surface 12*a* of the apparatus body 12. A side face 24*b* of the battery 24 is flush with a back face 12*c* of the apparatus body 12. Accordingly, the side face 24*b* of the battery 24 forms part of the back face 12*c* of the apparatus body 12.

Therefore, when the printer 10 is seen from above with the front face 12*b* oriented forward, the notch section 64, that is, the attachment area of the battery 24 can be visually observed during attachment and removal of the battery 24. In other words, there is no need to rotate the apparatus body 12 so that the back face 12*c* is oriented forward during attachment and removal of the battery 24. This facilitates attachment and removal of the battery 24. In addition, since the battery 24 fits into the apparatus body 12, the overall size of the apparatus becomes smaller and the portability of the apparatus is improved.

Further, since the upper surface 24*a* of the battery 24 is flush with the upper surface 12*a* of the apparatus body 12 in the state that the battery 24 is attached to the apparatus body 12, no step is formed on the upper surface 12*a* of the apparatus body 12. Accordingly, the portability and aesthetics of the printer 10 can be improved.

Further, since the side face 24*b* of the battery 24 is flush with the back face 12*c* of the apparatus body 12 in the state that the battery 24 is attached to the apparatus body 12, no step is formed on the back face 12*c*. Accordingly, the portability and aesthetics of the printer 10 can be improved.

As shown in FIG. 4, the battery 24 is disposed at the center of the apparatus body 12 in the X axis direction which is the width direction of the apparatus body 12. Accordingly, the weight of the entire apparatus is balanced in the X axis direction in the printer 10, thereby improving the portability of the printer 10.

The battery 24 is a known battery such as a lithium ion battery and is chargeable by an adapter, which is not shown in the figure. Further, the battery 24 includes lock release tabs 66 that unlock a known lock mechanism (not shown in the figure). The battery 24 is locked by the lock mechanism when attached to the notch section 64 of the apparatus body 12. The battery 24 is unlocked when the lock release tabs 66 are slid.

Referring to FIGS. 6 and 9, the battery 24 is disposed between the first drive motor 42 that drives the pick-up roller 38 and the second drive motor 52 that drives the transportation drive roller 46 in the X axis direction. Since the first drive motor 42 and the second drive motor 52 are disposed on each end of the battery 24 in the X axis direction, the weight of the entire apparatus is balanced in the X axis direction in the printer 10, thereby improving the portability of the printer 10.

Circuit Substrate

Next, a relation between a circuit substrate 74 disposed on the apparatus body 12 and the battery 24 will be described. Referring to FIGS. 5 and 6, the notch section 64 includes a frame 68. The frame 68 provides a surface that opposes the battery 24 in the notch section 64 when attached to the apparatus body 12. As shown in FIGS. 6 and 7, the apparatus body 12 includes an upper frame 70 and a lower frame 72. The frame 68 that forms the notch section 64 is provided as a separate member from the upper frame 70 and the lower frame 72 that form the apparatus body 12.

Referring to FIG. 8, the circuit substrate 74 on which a plurality of electronic components are mounted is disposed inside the apparatus body 12. The circuit substrate 74 includes a plurality of electronic components 76 which extend from the upper surface of the circuit substrate 74 in the positive Z direction by a predetermined amount or more. Further, the circuit substrate 74 is disposed in the apparatus body 12 so as to extend in the X-Y plane. Referring back to FIG. 3, the circuit substrate 74 is disposed at a position in the negative Z direction (on the lower side) of the battery 24 in the Z axis in FIG. 3.

Further, as shown in FIG. 3, the circuit substrate 74 extends in the Y axis direction from a position under the battery 24 toward the front face of the apparatus (in the negative Y direction). The electronic components 76 which extend from the upper surface of the circuit substrate 74 by a predetermined amount or more among the electronic components mounted on the circuit substrate 74 are disposed at positions near the end on the side of the front face of the apparatus in the Y axis direction, that is, on the side of the negative Y direction of the circuit substrate 74. Accordingly, the occupied region of the electronic components 76 in the Z axis direction overlaps the occupied region of the battery 24.

Further, the medium supporting section 36 which is formed to be inclined downward in the negative Y direction is disposed at a position in the negative Y direction of the battery 24 in the Z axis in FIG. 3. The electronic components 76 which are disposed at positions near the end on the side of the front face of the apparatus are positioned in a space (dead space) under the medium supporting section 36.

Since the electronic components 76 which extend upward from the circuit substrate 74 by a predetermined amount or more among a plurality of electronic components mounted on the circuit substrate 74 are positioned such that the occupied region of the electronic components 76 overlaps the occupied region of the battery 24 in the Z axis direction at positions near the end on the side of the front face of the apparatus and away from the end on the side of the battery 24 in the Y axis direction, the electronic components 76 which extend upward from the circuit substrate 74 by a predetermined amount or more can be efficiently positioned. This can prevent the height of the apparatus from being increased.

Further, since the medium supporting section 36 that supports at least part of the medium before feeding of the medium is formed to be inclined downward in the negative Y direction, a space is created under the medium supporting section 36. The electronic components 76 which extend upward from the upper surface of the circuit substrate 74 by a predetermined amount or more are positioned in the space. Accordingly, the space is effectively used, thereby contributing to reduction of the overall size of the apparatus.

As shown in FIGS. 3 and 6, the circuit substrate 74 is disposed under the battery 24. When the frame 68 that forms the notch section 64 is removed from the apparatus body 12, the circuit substrate 74 is accessible from the outside of the apparatus body 12.

The frame 68 that forms the surface which opposes the battery 24 in the notch section 64 is a separate member from the upper frame 70 that forms at least the upper surface 12*a* and the back face 12*c* of the apparatus body 12. Accordingly, the circuit substrate 74 disposed under the battery 24 and an area around the circuit substrate 74 can be easily accessed, thereby improving the operation efficiency during a wiring operation for the circuit substrate 74.

As shown in FIGS. 3 and 9, an ink storing unit 78 is disposed on the lower side of the battery 24 in the Z axis direction. The ink storing unit 78 stores the ink ejected from the recording head 56 during cleaning of the recording head 56 and the ink wasted during marginless printing of the medium via a recovering unit (not shown in the figure).

Summarizing the above, the printer 10 according to the present embodiment includes the apparatus body 12, the delivery section 34 that delivers the medium on which recording has been performed by the recording head 56, and the battery 24 which is removably attached on the upper surface of the apparatus body 12 and forms part of the upper surface 12*a* of the apparatus body 12 in a state that the battery 24 is attached. More specifically, the printer 10 according to the present embodiment includes the recording unit 32 which includes the recording head 56 that performs recording on the medium which is transported from the side of the back face 12*c* of the apparatus which is opposite to the front face 12*b* which forms the periphery of the apparatus body 12 to the side of the front face 12*b*, the delivery section 34 that delivers the medium on which recording has been performed by the recording head 56 from the side of the front face 12*b*, the notch section 64 formed at a corner formed by the upper surface 12*a* and the back face 12*c* of the apparatus body 12, and the battery 24 which is removably attached on the notch section 64 and forms part of the upper surface 12*a* and part of the back face 12*c* of the apparatus body 12 in a state that the battery 24 is attached.

The printer 10 further includes the medium supporting section 36 that supports at least part of the medium before feeding of the medium and is formed to be inclined downward in a feeding direction of the medium, and the medium supporting section 36 is disposed between the recording head 56 and the battery 24.

The printer 10 further includes a circuit substrate 74 on which a plurality of electronic components are mounted, and at least part of the plurality of electronic components is disposed between the medium supporting section 36 and the battery 24.

The upper surface 24*a* of the battery 24 is flush with the upper surface 12*a* of the apparatus body 12 in the state that the battery 24 is attached to the apparatus body 12. Further, the side face 24*b* of the battery 24 is flush with the back face 12*c* of the apparatus body 12 in the state that the battery 24 is attached to the apparatus body 12.

The battery 24 is disposed at the center of the apparatus body 12 in the X axis direction which extends between the right side face of the apparatus which intersects with the front face and the back face of the apparatus which form the periphery of the apparatus body 12 and the left side face of the apparatus which is opposite to the right side face of the apparatus. Further, the apparatus body 12 includes at least two drive motors, that is, the first drive motor 42 and the second drive motor 52. The first drive motor 42 and the second drive motor 52 are each disposed on each side of the battery 24 in the X axis direction.

The circuit substrate 74 is disposed under the battery 24 in a position along the lower surface (which is substantially parallel to the X-Y plane) of the battery 24 (that is, substantially parallel to the X-Y plane), and is sized to extend from a position under the battery 24 toward the recording head 56 (in the negative Y direction). The electronic components 76 which extend upward from the circuit substrate 74 by a predetermined amount or more among a plurality of electronic components are positioned such that the occupied region of the electronic components 76 overlaps the occupied region of the battery 24 in the Z axis direction at positions other than under the battery 24 in a plane direction of the circuit substrate 74.

In other words, the circuit substrate 74 is disposed under the battery 24 in a position along the X-Y plane which includes the X axis direction and the Y axis direction which extends from the front face to the back face of the apparatus in the apparatus body 12. The circuit substrate 74 is sized to extend from a position under the battery 24 toward the front face of the apparatus. The electronic components 76 which extend upward from the circuit substrate 74 by a predetermined amount or more among a plurality of electronic components are positioned such that the occupied region of the electronic components 76 overlaps the occupied region of the battery 24 in the Z axis direction at positions near the end on the side of the front face of the apparatus and away from the end on the side of the battery 24 in the Y axis direction.

The recording unit 32 includes the ink jet recording head 56 that ejects ink. The recording unit 32 further includes the ink storing unit 78 under the battery 24 so as to store the ink wasted from the ink jet recording head 56.

The printer 10 includes the medium supporting section 36 that supports at least part of the medium before feeding of the medium and is formed to be inclined downward in the negative Y direction (the feeding direction of the medium). The electronic components 76 which extend upward from the circuit substrate 74 by a predetermined amount or more are positioned in an area formed under the medium supporting section 36. Further, the frame 68 that forms the surface which opposes the battery 24 in the notch section 64 is a separate member from the upper frame 70 that forms at least the upper surface 12*a* and the back face 12*c* of the apparatus body 12.

Although the battery 24 according to the invention is applied to the ink jet printer as an example of recording apparatus in the present embodiment, the battery 24 may be applied to other liquid ejecting apparatuses in general. The liquid ejecting apparatuses are not limited to recording apparatuses such as printers, copy machines and facsimile machines that use an ink jet recording head and perform recording on the recording medium by ejecting ink from the recording head. The liquid ejecting apparatuses may include apparatuses that eject liquid suitable for the application instead of ink from a liquid ejecting head which corresponds to the ink jet recording head onto an ejection target medium which corresponds to the recording medium so as to apply the liquid on the ejection target medium.

Examples of liquid ejecting head may include, in addition to the recording head, color material ejecting heads used for manufacturing of color filters for liquid crystal displays and the like, electrode material (conductive paste) ejecting heads used for forming electrode for organic EL displays, field emission displays (FED) and the like, bioorganic ejecting heads used for manufacturing biochips and sample ejecting heads as a fine pipette.

The invention is not limited to the above embodiment and various modifications can be made within the scope of the invention defined in claims and such modifications are intended to be included in the scope of the invention. Although the battery 24 is provided on both the upper surface 12*a* and the back face 12*c* of the apparatus body 12 in the above embodiment, the invention is not limited thereto. For example, the battery 24 may be provided in the notch section which is provided only on the upper surface 12*a*. That is, the battery 24 may not form the back face 12*c* of the apparatus body 12 in the state that the battery 24 is attached.

The entire disclosure of Japanese Patent Application No. 2013-071635, filed Mar. 29, 2013 is expressly incorporated by reference herein.

What is claimed is:

1. A recording apparatus comprising:

an apparatus body which includes a recording unit that performs recording on a medium, wherein the apparatus body defines a notch section that is recessed into the apparatus body;

a delivery unit that delivers the medium on which recording has been performed by the recording unit; and a battery which is removably received in the notch section on an opposite side of the apparatus body relative to the delivery unit such that a first surface of the battery forms part of an upper surface of the apparatus, and a second surface of the battery forms part of a side surface of the apparatus, and only the first and second surfaces of the battery are exposed when the battery resides in the notch section.

2. The recording apparatus according to claim 1, further comprising a medium supporting section that supports at least part of the medium before feeding of the medium, the medium supporting section is formed to be inclined downward in a feeding direction of the medium, wherein the inclined medium supporting section is disposed between the recording unit and the battery.

3. The recording apparatus according to claim 2, wherein the recording unit includes a recording head that ejects ink and an ink storing unit that collects ink ejected from the recording head, wherein the ink storing unit is disposed under the battery.

4. The recording apparatus according to claim 2, wherein the apparatus body includes a first drive motor and a second drive motor, wherein the first drive motor is disposed on a first side of a medium transport path and the second drive motor is disposed on a second side of the medium transport path.

5. The recording apparatus according to claim 1, further comprising a feeding unit that supports at least part of the medium before feeding of the medium, the feeding unit including a medium supply unit cover configured to be openable and closeable, wherein one side of the medium supply unit cover includes a medium placing surface that is formed to be inclined downward in a feeding direction of the medium, wherein the battery is disposed under the medium supply unit cover when the medium supply unit cover is in the open position.

6. The recording apparatus according to claim 5, wherein the recording unit includes a recording head that ejects ink and an ink storing unit that collects ink ejected from the recording head, wherein the ink storing unit is disposed under the battery.

7. The recording apparatus according to claim 5, wherein the apparatus body includes a first drive motor and a second drive motor, wherein the first drive motor is disposed on a first side of a medium transport path and the second drive motor is disposed on a second side of the medium transport path.

8. The recording apparatus according to claim 5, wherein the side surface of the apparatus body is a back face of the apparatus body.

9. The recording apparatus according to claim 1, wherein the electronic component which extends from the circuit substrate by a predetermined amount or more is positioned in an area formed under the feeding unit.

10. The recording apparatus according to claim 1, wherein the recording unit includes a recording head that ejects ink and an ink storing unit that collects ink ejected from the recording head, wherein the ink storing unit is disposed under the battery.

11. The recording apparatus according to claim 1, wherein the recording unit includes a recording head that ejects ink and an ink storing unit that collects ink ejected from the recording head, wherein the ink storing unit is disposed under the battery.

12. The recording apparatus according to claim 1, wherein the apparatus body includes a first drive motor and a second drive motor, wherein the first drive motor is disposed on a first side of a medium transport path and the second drive motor is disposed on a second side of the medium transport path.

13. A recording apparatus comprising:

an apparatus body which includes a recording unit that performs recording on a medium;

a delivery unit that delivers the medium on which recording has been performed by the recording unit; and a battery which is attached on an opposite side of the apparatus body relative to the delivery unit and that forms part of an upper surface of the apparatus body in a state that the battery is attached, wherein the apparatus body includes a circuit substrate disposed inside the apparatus body, wherein a plurality of electronic components are mounted on the circuit substrate, wherein the circuit substrate is disposed under the battery when the battery is attached to the apparatus body and in a position below a lower surface of the battery, wherein the circuit substrate is sized to extend from the position below the lower surface of the battery the recording head, and wherein an electronic component which extends upward from the circuit substrate by a predetermined amount or more among the plurality of electronic components is positioned such that an occupied region of the electronic component overlaps an occupied region of the battery in a height direction of the apparatus at a position other than under the battery in a plane direction of the circuit substrate.

14. A recording apparatus comprising:

an apparatus body which includes a recording unit that performs recording on a medium;

a delivery unit that delivers the medium on which recording has been performed by the recording unit; and a battery which is attached on an opposite side of the apparatus body relative to the delivery unit and that forms part of an upper surface of the apparatus body in a state that the battery is attached, wherein the apparatus body includes a circuit substrate disposed inside the apparatus body, wherein a plurality of electronic components are mounted on the circuit substrate, wherein the circuit substrate is disposed under the battery when the battery is attached to the apparatus body and in a position below a lower surface of the battery.

* * * * *